United States Patent [19]

Schausberger et al.

[11] 4,187,023

[45] Feb. 5, 1980

[54] APPARATUS FOR WET TREATMENT OF RUNNING WEBS OF PHOTOGRAPHIC MATERIAL

[75] Inventors: Helmut Schausberger, Unterhaching; Rudolf Brunner, Münich, both of Fed. Rep. of Germany

[73] Assignee: AGFA-Gevaert, A.G., Leverkusen, Fed. Rep. of Germany

[21] Appl. No.: 919,271

[22] Filed: Jun. 26, 1978

[30] Foreign Application Priority Data

Jul. 8, 1977 [DE] Fed. Rep. of Germany ..... 2731045

[51] Int. Cl.[2] ..... G03D 3/02

[52] U.S. Cl. ..... 354/321; 354/322; 354/324; 134/64 P

[58] Field of Search ..... 354/319, 320, 321, 322, 354/323, 324, 331; 134/64 P, 122 P

[56] References Cited

U.S. PATENT DOCUMENTS

| | | | |
|---|---|---|---|
| 3,372,630 | 3/1968 | Schmidt | 354/321 |
| 3,405,626 | 10/1968 | Fleischer et al. | 134/122 P |
| 3,610,131 | 10/1971 | Frick et al. | 134/122 P |
| 3,616,742 | 3/1969 | Boyle et al. | 354/319 |
| 3,641,911 | 2/1972 | Aelterman et al. | 134/122 P |
| 3,988,756 | 10/1976 | Wick et al. | 354/319 |
| 4,023,190 | 5/1977 | Fassler | 354/319 |
| 4,101,919 | 7/1978 | Ammann | 354/324 |

FOREIGN PATENT DOCUMENTS

| | | | |
|---|---|---|---|
| 2213742 | 3/1972 | Fed. Rep. of Germany | 354/324 |

*Primary Examiner*—L. T. Hix
*Assistant Examiner*—Alan Mathews
*Attorney, Agent, or Firm*—Peter K. Kontler

[57] ABSTRACT

A film processor wherein two partitions divide the housing into a centrally located chamber, a first compartment between the film-admitting inlet and the chamber and a second compartment between the chamber and an outlet for evacuation of processed film. Each partition has a one-piece plastic flow restrictor with a horizontal slot for the film. The flow restrictors extend into the respective compartments and into immediate proximity of the peripheral surfaces of advancing rolls which are installed in the compartments to advance the film from the inlet into the chamber via one of the slots and from the chamber toward and into the outlet by way of the other slot. A system of pumps delivers processing liquid from a reservoir into the chamber at such a rate that the liquid level is above the slots. The liquid which escapes from the chamber into the compartments by way of the respective slots is returned into the reservoir.

28 Claims, 3 Drawing Figures

APPARATUS FOR WET TREATMENT OF RUNNING WEBS OF PHOTOGRAPHIC MATERIAL

BACKGROUND OF THE INVENTION

The present invention relates to apparatus for wet treatment of running webs of photographic material, e.g., to film processors. More particularly, the invention relates to improvements in apparatus for contacting both sides of a running web of photographic material with a liquid while the web advances lengthwise along a substantially horizontal path.

In many presently known film processors, a web of photographic material which is to be contacted with a liquid medium (e.g., in a developing machine wherein photographic material is contacted by developing, fixing and rinsing fluids) is fed into a chamber by a first pair of advancing rolls and is withdrawn from the chamber by a second pair of advancing rolls. That portion of the web which advances through the chamber is flanked (from above and from below) by plate-like guides which are closely adjacent to each other and have openings for directing streams of liquid against the respective sides of the running web. The configuration of the guides (especially in the region of the inlet for admission of the web into the chamber and in the region of the outlet where the web leaves the chamber) is selected in such a way that both sides of the running web are contacted by identical quantities of liquid as long as the pump or pumps which deliver liquid into the openings of the guides operate at a constant rate. This can be achieved only if the surfaces of the guides are machined with a high degree of precision and if the distance between the guides is selected with a very high degree of accuracy. It has been found that the extremely thin films of liquid at the two sides of a running web will be interrupted in immediate response to deviations of the output of the pump or pumps from a predetermined value. Each and every interruption of a liquid film entails non-uniform contact between liquid and successive increments of the running web, i.e., the exposed film which is treated in such apparatus will be developed at a non-uniform rate with attendant reduction of the quality of developed film frames.

A somewhat different film processor is disclosed in U.S. Pat. No. 4,023,190 granted May 10, 1977 to Fassler. The patentee provides a tank within a reservoir. The tank communicates with the reservoir and contains pairs of advancing rolls with means for sealing the inlet and outlet from the nearest advancing rolls. The sealing means engage the advancing rolls and are subjected to extensive wear. Moreover, the pumping means must circulate large quantities of liquid in order to maintain the level of liquid above the path for the webs of photographic material.

OBJECTS AND SUMMARY OF THE INVENTION

An object of the invention is to provide a simple, compact and relatively inexpensive apparatus which can insure predictable treatment of photographic material by a liquid even if the rate at which the liquid is circulated fluctuates within a wide range.

Another object of the invention is to provide the apparatus with novel and improved means for minimizing the escape of liquid from the chamber wherein the liquid contacts a running web or sheet of photographic material.

A further object of the invention is to provide the apparatus with novel and improved means for threading the leaders of webs through the processing chamber.

An additional object of the invention is to provide the apparatus with novel and improved means for collecting liquid which escapes from the processing chamber.

Another object of the invention is to provide an apparatus wherein the means for transporting webs of photographic material toward, through and from the processing chamber need not be maintained in frictional engagement with sealing devices.

A further object of the invention is to provide novel and improved flow restrictors which can be utilized in the apparatus to minimize the rate of escape of liquid from the processing chamber.

An additional object of the invention is to provide flow restrictors which can be used in different types of apparatus.

The invention is embodied in an apparatus for wet treatment of webs of photographic material (such webs may constitute continuous strips or a series of discrete sheets or web portions). The apparatus comprises a housing having an inlet and an outlet and including spaced-apart first and second internal partitions (which are preferably vertical or nearly vertical) to divide the interior of the housing into a processing chamber between the partitions, a first compartment between the inlet and the chamber and a second compartment between the second partition and the outlet. The first and second partitions respectively include first and second flow restrictors which are provided with aligned substantially horizontal first and second channels or slots communicatively connecting the chamber with the respective compartments. The apparatus further comprises means for transporting webs of photographic material from the inlet to the outlet via first and second slots, and such transporting means includes a first pair of horizontal advancing rolls installed in the first compartment and having a nip adjacent to the first slot, and a second pair of horizontal advancing rolls installed in the second compartment and having a nip adjacent to the second slot. Still further, the apparatus comprises a source of processing liquid (preferably a reservoir which communicates with the compartments), and one or more pumps or analogous means for supplying liquid from the source to the chamber at a rate which suffices to maintain the liquid level in the chamber above the slots, i.e., to insure that the web which advances through the chamber is completely surrounded by a body of liquid.

Each flow restrictor extends into the respective compartment and preferably into immediate proximity of the adjacent portions of the corresponding advancing rolls at both sides of the respective nip. This insures that the leakage of liquid from the chamber is minimal so that the pump or pumps must merely replace such quantities of liquid which are permitted to escape from the chamber into the compartments via corresponding slots and the minimal clearances between the flow restrictors and the adjacent advancing rolls.

Each flow restrictor preferably comprises a main portion which defines the respective slot and extends in the axial direction of the corresponding advancing rolls, and two end portions or flanges at the ends of the main portion. The flow restrictors can be mass produced from a suitable synthetic plastic material which can withstand the corrosive influence (if any) of the liquid and can be readily cleaned. Each flow restrictor may constitute a one-piece component which is inserted into a suitable opening of the corresponding partition.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
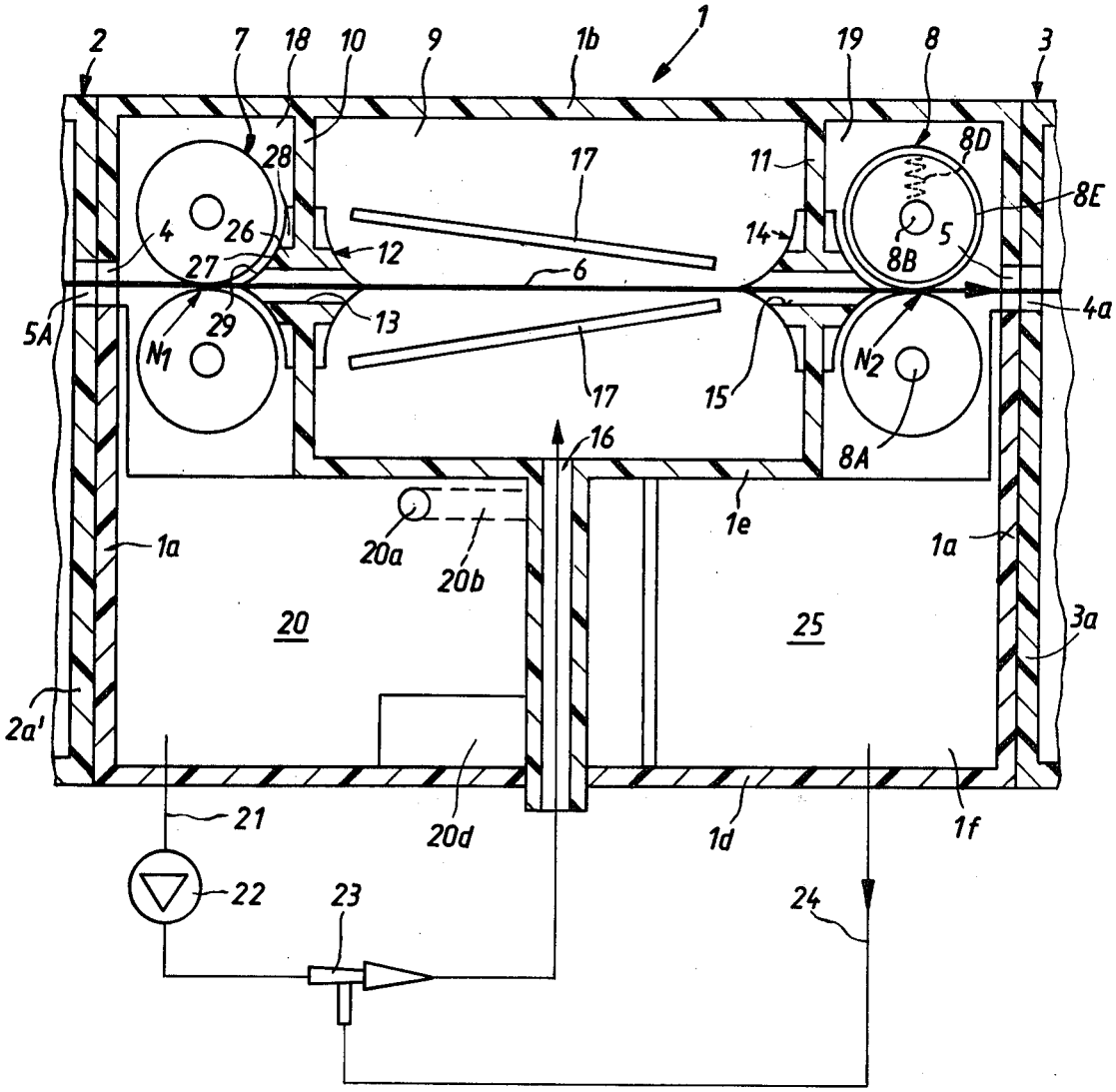
FIG. 1 is a longitudinal vertical sectional view of an apparatus which embodies one form of the invention.

Referring first to the embodiment of FIG. 1, there is shown an apparatus for wet treatment of webs 6 of photographic material, e.g., for developing exposed customer films. The apparatus comprises a housing 1 which is a hollow vessel and is disposed between two additional housings or vessels 2 and 3 wherein the webs 6 can undergo additional treatments. The housing 1 has a front wall 1*a* which is adjacent to the housing 2, a rear wall 1*a*′ which is adjacent to the housing 3, a top wall 1*b*, a bottom wall 1*d*, an intermediate wall 1*e* which is parallel to and spaced apart from the walls 1*b*, 1*d*, and two side walls 1*f* (only one shown). The front wall 1*a* of the housing 1 has an inlet 4 which registers with an outlet 5A in the adjacent rear wall 2*a*′ of the housing 2, and the rear wall 1*a*′ of the housing 1 has an outlet 5 which registers with an inlet 4A in the front wall 3*a* of the housing 3. In the embodiment of FIG. 1, the inlet 4 and the outlet 5 are located at the same level, i.e., a web 6 which enters the housing 1 via inlet 4 advances along a horizontal path toward and into the outlet 5.

The housing 1 further comprises two parallel vertical partitions 10, 11 which extend transversely of the path for the web 6 between the top wall 1*b* and intermediate wall 1*e* as well as between the remote side wall 1*f* and the nearer side wall (not shown) of the housing 1. These partitions divide the upper part of the interior of the housing 1 into a centrally located processing chamber 9, a first compartment 18 which is located between the front wall 1*a* and the partition 10, and a second compartment 19 located between the partition 11 and the rear wall 1*a*′. The means for transporting successive (interconnected or discrete) webs 6 from the inlet 4 toward the outlet 5 of the housing 1 comprises a first pair of horizontal advancing rolls 7 which are installed in the compartment 18 closely adjacent to the partition 10 and a second pair of horizontal advancing rolls 8 installed in the compartment 19 closely adjacent to the partition 11. The nips N1 and N2 of the advancing rolls 7 and 8 are located in a common horizontal plane which halves the inlet 4 and the outlet 5.

The partition 10 comprises a first flow restrictor 12 which is preferably a one-piece component consisting of injection molded synthetic plastic material and including a main or median portion 26 which defines a narrow horizontal slot or channel 13 in line with the nip N1 to permit the web 6 to advance from the compartment 18 into the chamber 9. The partition 11 comprises a similar flow restrictor 14 defining a horizontal channel or slot 15 through which the web 6 advances from the chamber 9 into the nip N2 of the advancing rolls 8 and thence toward and into the outlet 5.

The intermediate wall 1*e* (this is the bottom wall of the chamber 9) communicates with the discharge end 16 of a conduit 21 whose intake end communicates with the bottom zone of a reservoir 20 constituting a source of supply of processing liquid. When the apparatus is in use, a motor-driven first pump 22 which is installed in the conduit 21 draws liquid from the reservoir 20 and a jet pump 23 which is installed in the conduit 21 downstream of the pump 22 delivers liquid into the bottom portion of the chamber 9 via discharge end 16. The rate of admission of liquid is such that the chamber 9 is invariably filled to a level above the common level of the slots 13 and 15, i.e., the web portion between the flow restrictors 12 and 14 is submerged in a body of liquid. The pumps 22 and 23 must compensate for escape of liquid from the chamber 9 via slots 13 and 15.

The chamber 9 further contains plate-like guide elements 17 which are disposed above and below the path for the web 6 and converge toward each other in a direction from the slot 13 toward the slot 15 to guide the leader of a freshly introduced web into the slot 15 and thence into the nip N2 of the advancing rolls 8. The guide elements 17 are elongated, i.e., each thereof may extend almost along the full length of the chamber 9, as considered in the direction of transport of a web 6 from the inlet 4 toward the outlet 5.

The lower end of the compartment 18 communicates directly with the reservoir 20. The compartment 19 also communicates with the reservoir 20; in fact, it can be said that the reservoir 20 forms part of the compartments 18, 19 or vice versa.

The housing 1 further contains a tank 25 for a supply of spare liquid which is connected with a lateral inlet of the nozzle of the jet pump 23 by a further conduit 24. The conduit 24 admits processing liquid to the jet pump 23 when the supply of liquid in the reservoir 20 is depleted so that the pumps 22, 23 would be unable to maintain the liquid level in the chamber 9 above the slots 13 and 15. The reservoir 20 has an overflow opening 20*a* which is connected with the tank 25 by a pipe 20*b* so that the tank 25 receives liquid from the reservoir 20 when the latter is filled to a predetermined level. The reservoir 20 further contains a suitable liquid tempering or conditioning unit 20*d* which comprises means for maintaining the temperature of processing liquid within a desired range. The details of the conditioning unit 20*d* form no part of the present invention.

The system 20–25 which supplies liquid to the chamber 9 is somewhat similar to that which is disclosed in German Pat. No. 2,213,742 to which reference may be had if necessary.

The flow restrictor 15 is preferably identical with the flow restrictor 12. The latter comprises the aforementioned main or median portion 26 which is a flat horizontal slab defining the slot 13 and extending in parallelism with the axes of the advancing rolls 7 in a direction at right angles to the plane of FIG. 1. The flow restrictor 12 has two symmetry planes, namely, a first symmetry plane which coincides with the plane of the web 6 in the chamber 9 and a second symmetry plane which is normal to the first symmetry plane and divides the flow restrictor 12 into two mirror symmetrical halves respectively extending into the chamber 9 and into the compartment 18. The main or median portion 26 has a composite left-hand surface 27 which is immediately or closely adjacent to the peripheral surfaces of the advancing rolls 7 and is flat or concave, preferably concave so as to even more closely conform to the outlines of the adjacent portions of the advancing rolls 7. The flow restrictor 12 further comprises two end portions or flanges 28 which are located at the opposite ends of the median portion 26, as considered in the axial direction of the rolls 7 (FIG. 1 shows that flange 28 which is nearer to the illustrated side wall 1*f* of the housing 1). The flanges 28 have concave surfaces 29 which are immediately adjacent to the peripheral surfaces of the advancing rolls 7 so as to reduce the rate of liquid flow in the axial direction and toward the ends of the advancing rolls 7. The width of clearances between the surface 29 of the flange 28 which is shown in FIG. 1 and the adjacent portions of the peripheral surfaces of the rolls 7 is exaggerated for the sake of clarity. The apex of the surface 29 of the illustrated flange 28 preferably extends into immediate proximity of the nip N1 to further reduce the rate of escape of liquid from the chamber 9 into the compartment 18. The flanges 28 are preferably immediately adjacent to the respective ends of the median portion 26; as stated before, the entire flow restrictor 12 preferably constitutes a one-piece component consisting of a suitable synthetic plastic material and produced by injection molding or by resorting to another suitable mass-production technique. The surfaces 29 of the flanges 28 preferably merge into the surface 27 of the main portion 26, and the length of the portion 26 (and of its slot 13) at least equals the width of the web 6.

The width of the clearances between the peripheral surfaces of the advancing rolls 7 on the one hand and the surfaces 27, 29 of the flow restrictor 12 on the other hand is between 0.3 and 1.2 mm, preferably between 0.5 and 0.7 mm, and most preferably about 0.5 mm. The centers of curvature of the upper halves of the surfaces 27, 29 are preferably located on the axis of the upper advancing roll 7, and the centers of curvature of the lower halves of the surfaces 27, 29 are preferably located on the axis of the lower advancing roll 7. Each half of the surface 29 of a flange 28 can extend along an arc of approximately 90 degrees, i.e., from the three to the six o'clock position of the upper roll 7 and from the twelve to the three o'clock position of the lower roll 7. The apices of the surfaces 29 are preferably sharp so that they can extend into immediate proximity of or practically to the respective portions of the nip N1 of the advancing rolls 7.

In the embodiment of FIG. 1, the right-hand half of the flow restrictor 12 is not absolutely necessary, i.e., this flow restrictor could be replaced with one whose right-hand end is flush with the right-hand side of the partition 10. The same holds true for the left-hand half of the flow restrictor 14. Nevertheless, it is desirable (at this time) to construct the flow restrictors in such a way that each thereof consists of two mirror symmetrical halves one of which extends into the chamber 9 and the other of which extends into the respective compartment 18 or 19. The reasons for such design will be appreciated by looking at FIG. 2 which shows that additional advancing rolls 30, 31 can be provided in the chamber 9 adjacent to the partitions whereby the flow restrictor portions which extend into the chamber 9 cooperate with the additional advancing rolls 30, 31 to further reduce the rate of escape of liquid from the chamber 9 into the respective compartments 18, 19. Since the flow restrictors 12 can be mass produced of readily available materials, the difference between the cost of a flow restrictor 12 and a flow restrictor which corresponds to the left-hand or right-hand half of the flow restrictor 12 is negligible. Therefore, it is presently preferred to utilize flow restrictors of the type shown in FIG. 1 even though those halves of the flow restrictors which extend into the chamber 9 of FIG. 1 do not perform any important function.

The operation of the apparatus of FIG. 1 is as follows:

The prime mover means for the advancing rolls 7, 8 and for the pump 22 is started so that the pump 22 draws liquid from the reservoir 20 and the pump 23 admits the withdrawn liquid into the chamber 9 via discharge end 16 of the conduit 21. The chamber 9 is filled to capacity or nearly to capacity; in each instance to a level above the common plane of the slots 13 and 15. The jet pump 23 draws liquid from the tank 25 via conduit 24 in order to more rapidly fill the chamber 9 as well as to compensate for increased volume of circulating fluid which flows from the reservoir 20 into the chamber 9 and into the compartments 18, 19 via slots 13, 15. As mentioned above, the compartments 18, 19 communicate with and return escaping liquid to the reservoir 20. The quantity of liquid which escapes from the chamber 9 is relatively small due to the aforediscussed configuration of surfaces 27, 29 of the flow restrictors 12 and 14. It will be noted that the pumps 22, 23 circulate the liquid along endless paths one of which extends through the compartment 18 and the other of which extends through the compartment 19. When the motor for the pump 22 is arrested, the contents of the chamber 9 are gradually evacuated via slots 13 and 15, and the escaping liquid is returned into the reservoir 20. The surplus flows into the tank 25 via overflow opening 20*a* and pipe 20*b*. The opening 20*a* and pipe 20*b* insure that the liquid in the compartments 18, 19 cannot rise to the level of the inlet 4 and/or outlet 5.

The advancing rolls 7 and 8 are preferably mounted in a manner known from the art of squeegees, i.e., their peripheral surfaces are preferably smooth and one roll of each pair is preferably biased against the other roll of the respective pair. This is shown in FIG. 1 in connection with the advancing rolls 8. The shaft 8A of the lower advancing roll 8 is journalled in the two side walls of the housing 1 and is driven by a suitable prime mover (not shown) in synchronism with the shaft for one of the advancing rolls 7. The shaft 8B of the upper advancing roll 8 is biased by springs 8D or the like so that the smooth peripheral surface of the upper roll 8 bears against the smooth peripheral surface of the lower roll 8. The end portions of the shaft 8B are movable up and down in vertical guide slots machined into the side walls of the housing 1. It is further preferred to make at least a portion of at least one roll of each pair of advancing rolls 7 and 8 of a suitable elastomeric material. As shown in FIG. 1, the upper advancing roll 8 has a cylindrical portion 8E which consists of rubber or other suitable elastomeric material and defines the peripheral surface of the respective roll. This further reduces the likelihood of escape of appreciable quantities of liquid via nip N2. The advancing rolls 7 are preferably constructed and assembled in the same way as the advancing rolls 8.

Figure 2:
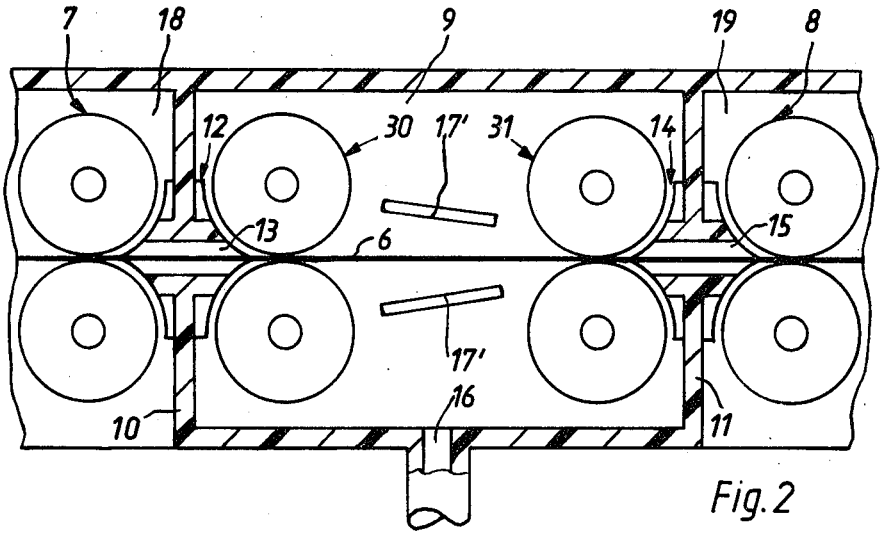
FIG. 2 is a fragmentary longitudinal vertical sectional view of a modified apparatus which comprises two pairs of advancing rolls in the processing chamber.

FIG. 2 shows a portion of a modified apparatus wherein the chamber 9 contains two pairs of the additional advancing rolls 30 and 31. The rolls 30 are immediately adjacent to the right-hand side of the partition 10 and cooperate with the right-hand half of the flow restrictor 12 in the same way as described in connection with the left-hand half of the flow restrictor 12 and the advancing rolls 7 of FIG. 1. The additional advancing rolls 31 are immediately adjacent to the left-hand side of the partition 11 and cooperate with the left-hand half of the flow restrictor 14.

An advantage of the apparaus of FIG. 2 is that the likelihood of escape of appreciable quantities of liquid from the chamber 9 is further reduced because the additional advancing rolls 30, 31 cooperate with the respective flow restrictors 12, 14 to reduce the flow of liquid from the chamber 9 into the slots 13 and 15.

Another advantage of the apparatus of FIG. 2 is that it permits for more predictable threading of the leader of a fresh web 6 through the chamber 9. Thus, the flow restrictor 12 directs the leader of the fresh web 6 into the nip of the advancing rolls 30, and such leader thereupon advances between two relatively short mutually inclined guide elements 17' toward the nip of the advancing rolls 31 which direct the leader into the slot 15.

Figure 3:
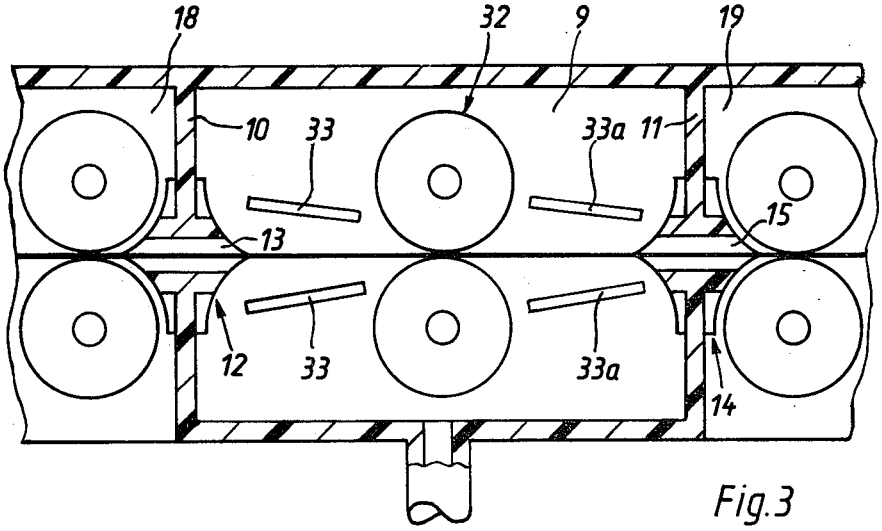
FIG. 3 is a fragmentary longitudinal vertical sectional view of a third apparatus with a single pair of advancing rolls in the processing chamber.

The embodiment of FIG. 3 comprises a single pair of additional advancing rolls 32 which are disposed in the chamber 9 substantially midway between the partitions 10 and 11. The apparatus of FIG. 3 further comprises a first pair of mutually inclined plate-like guide elements 33 between the flow restrictor 12 and the advancing rolls 32, and a second pair of similar guide elements **33*a* between the advancing rolls 32 and the flow restrictor 14. Such apparatus are especially suited for wet treatment of relatively short webs (e.g., discrete sheets) of photographic material. The guide elements 33, 33*a* and the additional advancing rolls 32 cooperate to insure that the leader of a very short web invariably advances from the slot 13 of the left-hand flow restrictor 12 toward and into the slot 15 of the right-hand flow restrictor 14**.

An important advantage of the improved apparatus is that the treatment of successive increments of a continuous or interrupted web which advances through the chamber 9 is uniform regardless of possible fluctuations of the rate of delivery of liquid by the pump 22 and/or 23. This is due to the fact that the rate at which the pumps deliver liquid into the chamber 9 need not correspond, at all times, to the rate of escape of liquid via slots 13 and 15. In other words, the pumps can fill the chamber 9 to capacity or at least to a level well above the common level of the slots 13, 15; this insures that each and every increment of the web 6 in the chamber 9 is contacted by identical quantities of processing liquid. In other words, eventual fluctuations of the rate of liquid delivery to the chamber 9 are of no consequence, as long as the pumps deliver liquid at a rate which exceeds (or is not less than) the maximum rate of escape of liquid from the chamber 9.

Another important advantage of the improved apparatus is its simplicity and low cost. Thus, it is not necessary to employ accurately machined components which define narrow channels for admission of successive increments of a running web into and for movement of successive increments of such web through and from the processing chamber. As mentioned above, the flow restrictors 12 and 14 can be mass produced at a low cost and can be designed to be useful in apparatus of the type shown in FIGS. 1 and 3 or in apparatus of the type shown in FIG. 2. In conventional apparatus, the parts which define slots or channels for admission of a web into, for guidance of a web in and for evacuation of a web from the processing chamber must be adjusted with a high degree of accuracy. The flow restrictors 12 and 14 need not be adjusted at all, i.e., their flow restricting and web guiding action remains unchanged. Moreover, a damaged flow restrictor can be readily replaced with a fresh flow restrictor, and the slots 13, 15 can be readily cleaned, especially if the flow restrictors consist of a synthetic plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of eqivalence of the claims.

What is claimed is:

1. Apparatus for wet treatment of webs of photographic material, comprising a housing having an inlet and an outlet, said housing including spaced-apart first and second internal partitions which divide the interior of said housing into a processing chamber between said partitions, a first compartment between said inlet and said first partition, and a second compartment between said second partition and said outlet; a source of processing liquid; means for supplying liquid from said source to said chamber and for maintaining a body of the liquid in said chamber at a predetermined level; means for passing webs of photographic material between said compartments and said chamber through said first and second partitions, including first and second flow restrictors respectively having aligned substantially horizontal first and second slots communicatively connecting said chamber with the corresponding compartments below said predetermined level and having such dimensions as to permit the webs to pass therethrough without hindrance and to restrict the outflow of the liquid therethrough from said chamber into said compartments to a minimum; and means for transporting webs of photographic material from said inlet to said outlet via said first and second slots and through said body of liquid below said predetermined level, including a first pair of horizontal advancing rolls installed in said first compartment and having a nip adjacent to said first slot and a second pair of advancing rolls installed in said second compartment and having a nip adjacent to said second slot.

2. Apparatus as defined in claim 1, wherein said advancing rolls have smooth web-contacting peripheral surfaces.

3. Apparatus as defined in claim 1, wherein one roll of each pair of advancing rolls is rotatable about a fixed axis and further comprising means for biasing the other roll of each pair of advancing rolls against the respective one roll.

4. Apparatus as defined in claim 1, wherein at least one roll of each pair of advancing rolls includes an elastic portion and such elastic portion is adjacent to the periphery of the respective roll.

5. Apparatus as defined in claim 1, wherein each of said flow restrictors extends from the respective partition into the corresponding compartment and into close proximity of the respective advancing rolls so as to minimize the flow of liquid from the respective slot, along the peripheries of the adjacent advancing rolls and into the corresponding compartment.

6. Apparatus as defined in claim 1, wherein each of said flow restrictors includes a main portion which defines the respective slot and extends in substantial parallelism with the axes of the respective advancing rolls.

7. Apparatus as defined in claim 1, wherein each of said flow restrictors is a one-piece component.

8. Apparatus as defined in claim 7, wherein each of said components consists of synthetic plastic material.

9. Apparatus as defined in claim 8, wherein each of said components is an injection-molded component.

10. Apparatus as defined in claim 1, further comprising guide means installed in the chamber above and below the level of said slots and arranged to guide the leader of a fresh web during transport of such leader from said first slot toward and into said second slot.

11. Apparatus as defined in claim 10, wherein said guide means includes mutually inclined plate-like elements which converge in a direction from said first slot toward said second slot.

12. Apparatus as defined in claim 1, wherein said source comprises a reservoir communicating with said compartments to collect liquid which flows from said chamber into said compartments through the respective slots.

13. Apparatus as defined in claim 12, wherein said liquid supplying means comprises conduit means connecting said reservoir with said chamber, a first pump installed in said conduit means and arranged to draw liquid from said reservoir, and a jet pump installed in said conduit means downstream of said first pump and arranged to admit liquid into said chamber.

14. Apparatus as defined in claim 13, further comprising a liquid-containing tank and additional conduit means connecting said tank with said jet pump to deliver thereto liquid when the supply of liquid in said reservoir is insufficient to maintain the liquid level in said chamber above said slots.

15. Apparatus as defined in claim 14, further comprising means for conveying liquid from said reservoir to said tank when said reservoir is filled to a predetermined level.

16. Apparatus as defined in claim 12, wherein at least one of said compartments is in direct communication with said reservoir.

17. Apparatus as defined in claim 12, wherein said reservoir forms part of said compartments.

18. Apparatus for wet treatment of webs of photographic material having a predetermined width, comprising a housing having an inlet and an outlet, said housing including spaced-apart first and second internal partitions which divide the interior of said housing into a processing chamber between said partitions, a first compartment between said inlet and said first partition, and a second compartment between said second partition and said outlet, said first and second partitions respectively having aligned substantially horizontal first and second slots communicatively connecting said chamber with the corresponding compartments; means for transporting webs of photographic material from said inlet to said outlet via said first and second slots, including a first pair of horizontal advancing rolls installed in said first compartment and having a nip adjacent to said first slot and a second pair of advancing rolls installed in said second compartment and having a nip adjacent to said second slot; first and second flow restrictors respectively rigid with said first and second partitions and each including a main portion which defines the respective slot, extends in substantial parallelism with the axes of the respective advancing rolls, and has a length which, as considered in the axial direction of the respective advancing rolls, at least equals said predetermined width, said main portions having surfaces closely adjacent and substantially complementary to the peripheral surfaces of the respective advancing rolls in the regions of the corresponding nips; a source of processing liquid; and means for supplying liquid from said source to said chamber at a rate which suffices to maintain the liquid level in said chamber above said slots.

19. Apparatus as defined in claim 18, wherein said surfaces of said main portions are concave surfaces.

20. Apparatus as defined in claim 18, wherein the surfaces of said main portions and the peripheral surfaces of the respective advancing rolls define clearances having a width of between 0.3 and 1.2 mm.

21. Apparatus as defined in claim 20, wherein the width of said clearances is between 0.5 and 0.7 mm.

22. Apparatus as defined in claim 18, wherein each of said flow restrictors further comprises two flanges disposed at the opposite ends of the respective main portion, as considered in the axial direction of the corresponding advancing rolls, said flanges having surfaces closely adjacent to the peripheral surfaces of the respective advancing rolls and extending into immediate proximity of the corresponding nips.

23. Apparatus as defined in claim 22, wherein said surfaces of said flanges are concave surfaces whose centers of curvature are located on the axes of the respective advancing rolls.

24. Apparatus as defined in claim 22, wherein said flanges are immediately adjacent to the respective ends of the corresponding main portions.

25. Apparatus for wet treatment of webs of photographic material, comprising a housing having an inlet and an outlet, said housing including spaced-apart first and second internal partitions which divide the interior of said housing into a processing chamber between said partitions, a first compartment between said inlet and said first partition, and a second compartment between said second partition and said outlet, said first and second partitions respectively including first and second flow restrictors respectively having aligned substantially horizontal first and second slots communicatively connecting said chamber with the corresponding compartments; means for transporting webs of photographic material from said inlet to said outlet via said first and second slots, including a first pair of horizontal advancing rolls installed in said first compartment and having a nip adjacent to said first slot, a second pair of advancing rolls installed in said second compartment and having a nip adjacent to said second slot, and at least one additional pair of advancing rolls installed in said chamber; a source of processing liquid; and means for supplying liquid from said source to said chamber at a rate which suffices to maintain the liquid level in said chamber above said slots.

26. Apparatus as defined in claim 25, wherein said additional advancing rolls are closely adjacent to one of said partitions and the flow restrictor of said one partition includes a portion extending into close proximity of the advancing rolls in said chamber.

27. Apparatus as defined in claim 25, wherein the nip of said additional advancing rolls is substantially aligned with said slots and further comprising first and second guide means provided in said chamber and respectively disposed between said additional advancing rolls and said first and second partitions to guide the leader of a fresh web from said first slot to the nip of said additional rolls and from the nip of said additional rolls toward said second slot.

28. Apparatus as defined in claim 25, further comprising another pair of said additional advancing rolls installed in said chamber, said pairs being respectively adjacent to said first and second partitions, said first and second flow restrictors having portions respectively extending into close proximity of said additional advancing rolls of said one and said other pair.

* * * * *